US006443717B1

(12) United States Patent
Barber

(10) Patent No.: US 6,443,717 B1
(45) Date of Patent: Sep. 3, 2002

(54) VARIABLE TIMING VALVES FOR GAS COMPRESSORS AND EXPANDERS

(76) Inventor: Jeffrey Lewis Barber, P.O. Box 971, Indian Hills, CO (US) 80454

( * ) Notice: Subject to any disclaimer, the term of this patent is extended or adjusted under 35 U.S.C. 154(b) by 0 days.

(21) Appl. No.: 09/687,793

(22) Filed: Oct. 12, 2000

Related U.S. Application Data

(60) Provisional application No. 60/158,853, filed on Oct. 12, 1999.

(51) Int. Cl.[7] ..... F04B 7/00
(52) U.S. Cl. ..... 417/510; 429/22
(58) Field of Search ..... 417/273, 510; 429/22, 27; 222/146.5; 95/100

(56) References Cited

U.S. PATENT DOCUMENTS 5,560,999 A * 10/1996 Pedicini et al. ..... 429/27
5,779,452 A * 7/1998 McCombie ..... 417/273
6,063,161 A * 5/2000 Keefer et al. ..... 95/100
6,082,978 A * 7/2000 Tetour et al. ..... 417/510
6,216,917 B1 * 4/2001 Crouch ..... 222/146.5
6,283,723 B1 * 9/2001 Milburn et al. ..... 417/273
2001/0016276 A1 * 8/2001 Yamanashi ..... 429/22
2001/0018142 A1 * 8/2001 Kato et al. ..... 429/22

* cited by examiner

*Primary Examiner*—Mark Paschall
*Assistant Examiner*—Leonid Fastovsky
(74) *Attorney, Agent, or Firm*—Charles E. Rohrer

(57) ABSTRACT

Variable valve timing is provided to control compressors and expanders in a fuel cell powering system in order to provide for matching the displaced volume of the compressor and expander over a range of pressure delivery requirements. A movable timing edge is positioned adjacent inlet and/or discharge ports to cooperate with a movable valve element with inlet and outlet slots to adjust the time and time period of open and close operations. Several embodiments are presented.

18 Claims, 6 Drawing Sheets

VARIABLE TIMING VALVES FOR GAS COMPRESSORS AND EXPANDERS

This application claims the benefit of Provisional Patent Application No. 60/158,853 filed Oct. 12, 1999.

RELATED PATENT APPLICATION

U.S. patent application Ser. No. 09/687,792 filed concurrently herewith, entitled "Process Control for Multiple Air Supplies."

FIELD OF THE INVENTION

This invention relates to a variable valve timing mechanism for use in controlling gaseous flow and pressure to or from fluid displacement apparatus used in various applications including fuel cell systems.

BACKGROUND OF THE INVENTION

In order to provide a wide range of power output, fuel cell powering systems need to have precise and independent control of the mass flow and pressure of gases used in the fuel cell process. For automotive applications, where minimizing the size and weight of the powering system is also important, the use of high gaseous pressure to obtain adequate power for the vehicle is generally regarded as a superior approach. However as pressure needs increase, the generation of pressure is more problem filled. In order to minimize the energy cost of generating high inlet pressures using a compressor, there is general agreement that an expander should also be used to recover unused energy and thereby improve system efficiency.

While recovery of energy is important for system efficiency, it is not possible to have a well matched compressor/expander pair, except at one operating point, unless there is an ability to modify the displaced volume of the compressor, the expander or both, during operation. When the compressor and expander are not well matched, their combined efficiency drops rapidly resulting in a similar decrease in the efficiency of the fuel cell powering system. When a fuel cell powering system is used to power vehicles, it must meet the dynamic power requirements of the vehicle, it must contribute to good fuel economy, and it must aid in meeting the emissions requirements typical of automotive applications. To accomplish such objectives, the fuel cell system must provide an energy efficient level of performance over a wide operating range. Since the gaseous fluid supply system represents one of the largest parasitic energy costs of the fuel cell powering system, it is especially important to provide a well matched, compressor/expander pair over the same wide operating range.

The ability of fluid delivery and energy recovery apparatus (hereafter fluid supply apparatus), compressors and expanders, to pump fluids (volumetric efficiency) is highly dependent upon the speed of the apparatus as well as the pressure requirements of the using devices. Typically, as either speed is decreased or pressure increased, the volumetric efficiency of the fluid supply apparatus deteriorates. Such a result causes an increase in energy consumption in the compressor and/or a decrease in energy recovery from the expander. An ideal compressor/expander pairing for a vehicular fuel cell application would show little change in volumetric efficiency as speed or system pressure requirements change.

Some types of fluid supply apparatus are better suited to the delivery of fluid over a wide range of pressure than other types. Low leakage fluid supply apparatus such as sealed pistons, sealed diaphragms, and sealed scrolls have a significantly greater pressure range than clearance roots, turbocompressors, clearance twin screws and similar fluid supply apparatus. However, all compressors and expanders, even those with seals, exhibit the characteristic of changing volumetric efficiency, as speed and pressure requirements change. These unavoidable changes in the ability of the apparatus to move a specific amount of fluid at a specific pressure at a specific speed complicates the establishment of an adequate fuel cell drive system for applications such as automotive use. The typical non-linear behavior of compressors and expanders further increase the difficulty when both are present in the powering system and should be matched for system efficiency as noted above. Therefore, what is needed is an independent, variable control mechanism to compensate for volumetric efficiency changes as well as to provide for a user selectable system pressure capability at all operating conditions. One solution is the variable displacement piston fluid supply apparatus described in U.S. Pat. Nos. 4,907,950, 5,004,404 and 5,114,321, incorporated herein by reference. That apparatus has demonstrated the required pressure control capability and compensation for changes in volumetric efficiency. This invention is for an alternative or complementary mechanism to accomplish the objectives through variable valve timing to achieve dynamic modulation of the displaced volume of a compressor and/or expander.

SUMMARY OF THE INVENTION

Briefly stated, this invention is a mechanism, system and method for controlling mass flow and pressure for systems utilizing fluid supply apparatus, and is intended particularly for meeting the stringent requirements of fuel cell powering systems used in vehicular applications. Control is achieved through a variable valve timing approach, and alternative embodiments are described.

One embodiment is a rotating disc valve positioned above the inlet and discharge ports of the fluid supply apparatus. The disc contains slots that are aligned with the ports to connect or block connection of the ports to associated delivery or exhaust lines, depending on the position of the slots in the rotating disc. Multiple slots are used to reduce the speed of disc rotation. A movable plate(s) is used to provide an adjustable timing edge to modify the opening and/or the closing of the ports. In that manner, the positioning of the timing edge is independent of the rotational speed of the rotating disc and is also independent of the rotational speed of the compressor and/or expander. If multiple compressors and/or expanders are included in a system, each compressor and expander can be independently controlled since each can be provided with an independently controllable timing edge. The positioning of the timing edge is dynamically controllable by making it a part of a servo system.

A second embodiment is a rotary cylinder valve with a movable timing edge. Other embodiments utilize reciprocating valve motion instead of rotary motion and do not require a timing edge. In these embodiments an actuator capable of stepping motion in both directions is utilized to move the valve structure to open and close position for periods of time that are variable in accordance with actuator control.

DETAILED DESCRIPTION

In an effort to reduce system complexity, cost and improve overall device performance, a pressure control approach utilizing variable valve timing on the expander inlet is described herein. Controlling the duration of the expander inlet is equivalent to changing the pumped volume per unit time, resulting in a change in the system pressure. For example, if the volume per unit time removed by an expansion device is reduced by half, while the volume delivered by the fuel cell's compressor is kept the same, conservation of mass flow $$PV=mRT=\text{constant}$$

dictates that the system pressure would double. This simple example assumes that the volumetric efficiencies of both devices are unchanged, which is not true for actual devices, but the principle is illustrated. One of the unique advantages of both the variable displacement and variable valve timing approaches to volume flow control is the ability to minutely adjust the air system to compensate for those undesirable, yet unavoidable, changes in the efficiency of fluid supply apparatus.

Variable timing can be implemented on either or both compressor and expander. The simplest configuration providing pressure control over the powering range of fuel cells, is to implement variable timing into the expander and the following description illustrates the invention by timing the expander inlet. While there are several different ways that variable valve timing can be implemented for a fuel cell compressor and/or expander air system, the following description begins with the presently preferred embodiment of a continuously rotating disc with movable timing edges. Some alternative timing approaches are also described.

Figure 1:
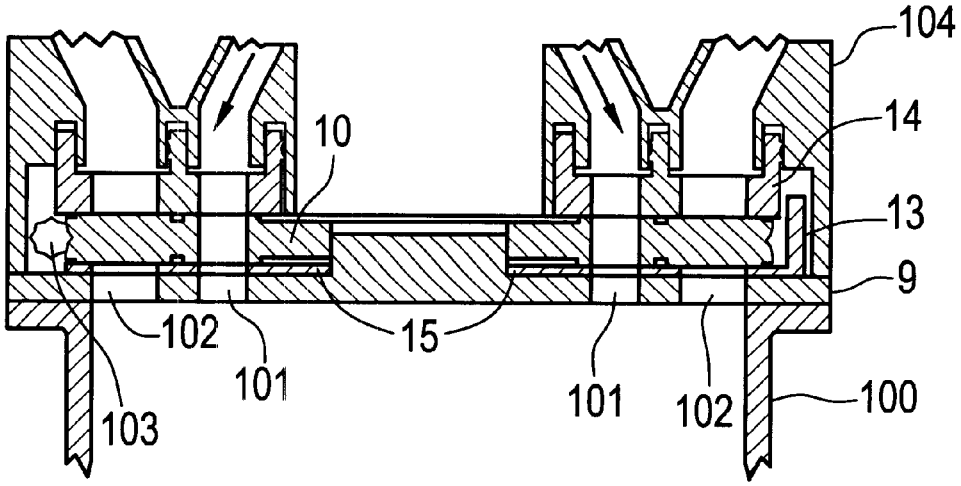
FIGS. 1–3 show a first embodiment of the variable timing valve of this invention with a movable timing edge.
Figure 2:
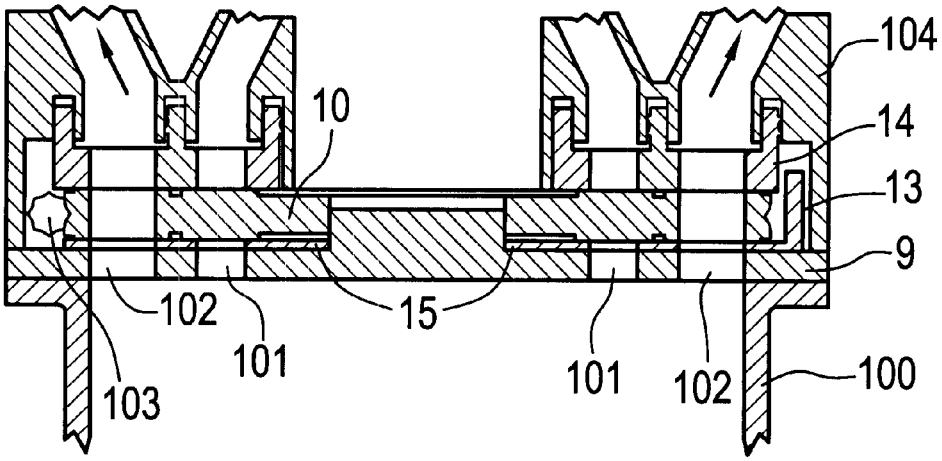

FIGS. 1 and 2 show a cross-section of a cylinder 100 which is part of a piston type fluid supply apparatus such as the pumps shown in the patents incorporated by reference, supra. A stationary cylinder head 9 has an inner annulus of fixed openings, inlet ports 101, and an outer annulus of fixed openings, discharge ports 102. A rotating disc 10 is positioned adjacent to the cylinder head 9 and contains an inner annulus 11 (FIG. 3) of slots to connect with the inlet ports 101 and an outer annulus 12 (FIG. 3) of slots to connect with the discharge ports 102. A timing plate 15 is positioned between the cylinder head 9 and the rotating disc 10. Timing plate 15 contains slots which are commensurate in size to the inlet ports 101. The position of the slots in plate 15 are adjustable with respect to the inlet ports 101 so that the opening of inlet ports 101 through the inner annulus 11 of slots in rotating disc 10 can be controlled. A lever arm 13 is connected to timing plate 15 for adjusting plate position. In that manner, timing plate 15 provides an adjustable timing edge for the opening of the inlet ports. If desired a similar timing plate could be provided for controlling the closing of inlet ports 101 and timing plates could be provided for controlling the opening and closing of discharge ports 102. Note that this arrangement affords a control over mass flow which is independent of the speed of rotating disc 10. Rotating disc 10 is driven by a gear 103 at a rate dependent on the number of slots in the two annuluses 11 and 12 of slots. A non-rotating pressure biased (a spring biased) manifold interconnect plate 14 is located next to rotating disc 10 and is connected to the inlet/outlet manifold 104.

FIG. 1 shows the position of the rotary disc valve 10 for an inlet event and FIG. 2 shows the position of rotary disc valve 10 for a discharge event. Adjustable timing plate 15 is shown in a position providing maximum opening time to the inlet ports 101.

Figure 3:
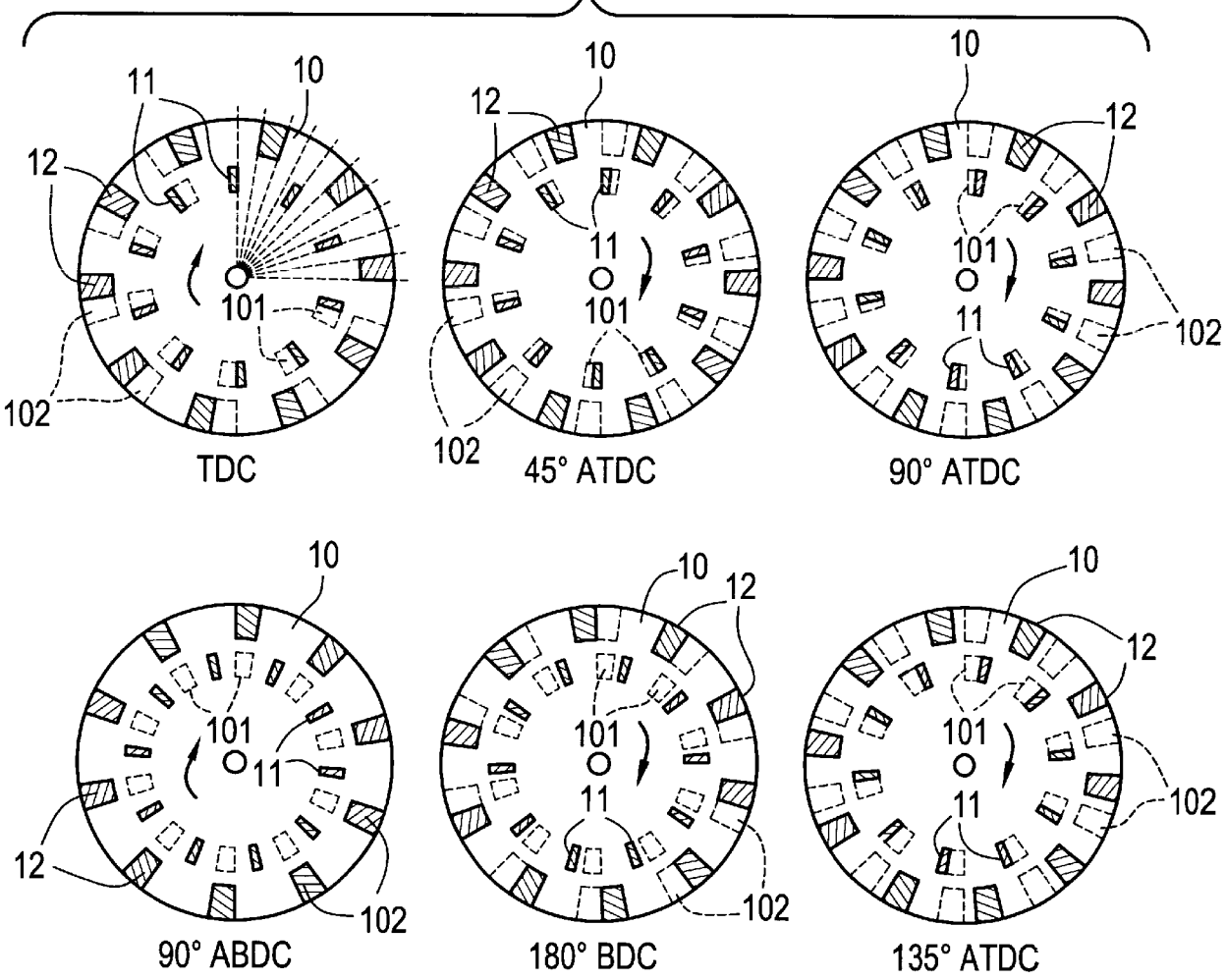

FIG. 3 shows a timing schematic diagram as disc valve 10 rotates in a clockwise direction. At top dead center (TDC), a designation of piston position in cylinder 100, the slots in annulus 11 (shown with cross-hatching) are about to enter a connection with inlet ports 101 while the slots in annulus 12 (shown with cross-hatching) have just completed being open to discharge ports 102. At 45° after top dead center (ATDC), and at 90° after top dead center, the slots in annulus 11 provide connection to inlet ports 101 while discharge ports 102 are closed by the land area between slots in annulus 12. At 135° after top dead center, the slots in annulus 11 have just completed being open to inlet ports 101 and at 180°, i.e., bottom dead center (BDC) the discharge event is about to begin as the slots in annulus 12 reach the edge of fixed discharge ports 102. At 90° after bottom dead center (ABDC), the discharge ports are completely open.

Control over the opening of inlet ports 101 is provided by the adjustable timing plate 15 which can be positioned to block a portion of the inlet ports 101 by moving lever arm 13 (FIG. 1) in a clockwise direction.

FIGS. 1–3 show the preferred embodiment for implementing variable timing with a rotating disc valve 10. Two annular arrangements 11 and 12 (FIG. 3) of equally spaced slots are located in rotating disc 10. One annulus 11 of slots is dedicated to the inlet while the other annulus 12 of slots is for discharge of the pumped fluid. The disc rotates over ports located in the cylinder head 9 so that the annulus of inlet slots simultaneously connect the cylinder to the inlet line and, as the disc rotates, closes the inlet slots and opens the discharge slots to connect the cylinder to the discharge line. In that manner, the slots of each annulus, both of which are contained in the rotating disc, provide openings to allow fluid flow into or out of the expander. Though the timing for both opening and closing can be independently controlled and varied, the simple embodiment shown for illustrative purposes in FIGS. 1–3 provides only for independent control over the timing of valve opening.

Important criteria for valve mechanisms are durability, reliability, and high efficiency in minimizing flow losses and actuation energy. While a single slot in each inlet or discharge annulus could be implemented, such a configuration would mandate a one for one speed ratio of the rotating disc with the expansion event. By increasing the number of slots in the annular arrangement shown, a corresponding reduction in the disc speed can be obtained. Since speed is a critical component in the magnitude of friction development and thereby in the determination of component life, reducing the rotational speed of the disc is highly desirable. Therefore, with 8 slots per annulus, the disc rotates at ⅛ the speed of the expansion device. With ten slots per annulus, the disc rotates at 1/10 the speed of the device.

FIG. 1 shows the rotating disc 10 sandwiched between two stationary plates, one is the cylinder head 9 and the other is a manifold connection 14. All components are in intimate contact with one another and are held together with either system pressure and/or a biasing spring mechanism. While the cylinder head 9 has a pattern of slots arranged in two annuluses similar to the rotating disc, the manifold connecting plate 14 does not. FIG. 1 shows the rotating disc 10 in a position to fully open the inlet slots and shows that the inlet port is the inner annulus 11 of slots. FIG. 2 shows the rotating disc in position to fully open the discharge slots and that the discharge port is the outer annulus 12 of slots.

The manifold plate 14 provides for sealing on one side of the rotating disc to seal between the annuluses, as well as sealing between the two annuluses and the environment. The manifold plate also provides for a low cost means of obtaining radial compliance that readily compensates for assembly discrepancies between the top of the cylinder head and the manifold bottom. The manifold plate 14 also provides for unobstructed flow paths to and from inlet/outlet manifold 104 and cylinder 100.

The rotating disc moves in a smooth continuous fashion, and under steady state conditions, does not experience acceleration forces. Alternative mechanical methods of generating a similar valving event, which utilize reciprocating or stepped rotational motion, create potentially large acceleration forces that are highly undesirable for efficiency sensitive applications such as fuel cell powering systems. The continuous, smooth rotational motion of the rotating disc is currently preferred over other approaches because it requires the least amount of valve actuation energy.

FIG. 3 shows that the rotating disc, in an alternating fashion, provides openings (slots in annulus 11), that when aligned with a corresponding set of fixed openings in the cylinder head 9 allows for fluid to flow from the inlet manifold into the expansion volume of the fluid supply apparatus. Fluid continues to flow through the slots in the rotating disc until it has traveled the entire width of the larger fixed openings in the cylinder head. No further flow through that rotating slot occurs once that slot is completely obstructed by a solid region in the stationary cylinder head. For variable timing of the opening, a movable plate 15, shown in FIG. 1 as imbedded and/or sandwiched between the cylinder head 9 and rotating disc 10, can be used to adjust the width of the stationary cylinder slot, as seen by the slot in the rotating disc. Changing the effective width of the cylinder opening either prolongs or shortens the time period that the rotating inlet slots coincide with corresponding cylinder openings. The volume flow, and therefore mass flow, into the expansion device correspondingly increases or decreases according to the conservation of mass flow principle mentioned above. In that manner, the adjustable position of plate 15 provides a timing edge for the inlet ports of the fluid supply apparatus. As the rotating disc continues its movement, now with all slots obstructed by solid material in the cylinder head, the inlet volume just admitted into the cylinder undergoes an expansion process. At the completion of the expansion process all of the discharge slots begin to pass over corresponding openings in the cylinder head allowing the expanded volume to be expelled from the device.

Although not shown in FIGS. 1, 2 and 3, a timing mechanism similar to movable plate 15 can be implemented on the discharge slots, thereby modifying the opening and/or the closing of the discharge ports. Such an approach may be useful in preventing over-expansion from occurring. Over-expansion results in a below ambient pressure discharge and results in the consumption of energy by the expander. Exposing the expansion volume to the environment, at an appropriate moment in the expansion cycle, minimizes any such undesirable energy consumption by the expander.

It is important to note that the movement and positioning of the adjustable timing edge is independent of the disc valve's rotational speed and is also independent of the expander's shaft rotational speed. In addition, if several expansion volumes are connected onto the same drive train, each with a variable valve mechanism, each adjustable timing edge can be manipulated independent of the other. In that manner, the invention provides for the control of several different pressurized flow streams where several such streams are present within the system. If desirable, the timing edge can be part of a servo system for automatic adjustment as sensors dictate through a servo control unit.

To minimize friction, the disc 10 is designed such that the part of the disc connected to high pressure is restricted to a minimal amount of disc area. The amount of area is just sufficient to prevent lift off of the rotating disc sealing surfaces during operation. This design approach minimizes pressure loading and therefore the friction generated by the disc's operation.

If needed, provision can be made for controlled leaks of high pressure air into confined volumes located opposite the high pressure gas stream, between the rotating disc and the stationary cylinder head. This technique can further reduce the pressure loading of the rotating disc against the cylinder top, thereby further reducing friction and the associated drive force requirements.

For PEM fuel cell applications, high rates of water condensation can be expected within the expander. The primary location of condensed water is on the surfaces within the expansion volume. For this reason, the discharge ports are located in an equally spaced annulus, directly above the cylinder walls as shown in FIGS. 1 and 2. This configuration allows for moving the liquid water out of the cylinder by the shortest distance from the interior of the expansion volume to the discharge manifold. This particular configuration also allows for an effective "squeegee" of the water along the walls into the discharge manifold. Thus any water remaining in the cylinder collects immediately in front of the discharge valve. Upon the next exhaust cycle, the previously entrapped liquid water would be immediately in front of the discharge port and therefore the first to leave the expansion volume when the valve opens. This design prevents the build up of liquid water within the expansion volume. If such a build up were allowed to occur, it would eventually prove detrimental to the expander device. It is advantageous to locate the discharge valve under the expansion cylinder so that gravity aids the process.

Another design feature preventing damage to the expander device due to the presence of liquid water, is to open the discharge valve during any significant motion of the piston in which the expansion volume is being reduced.

Figure 4:
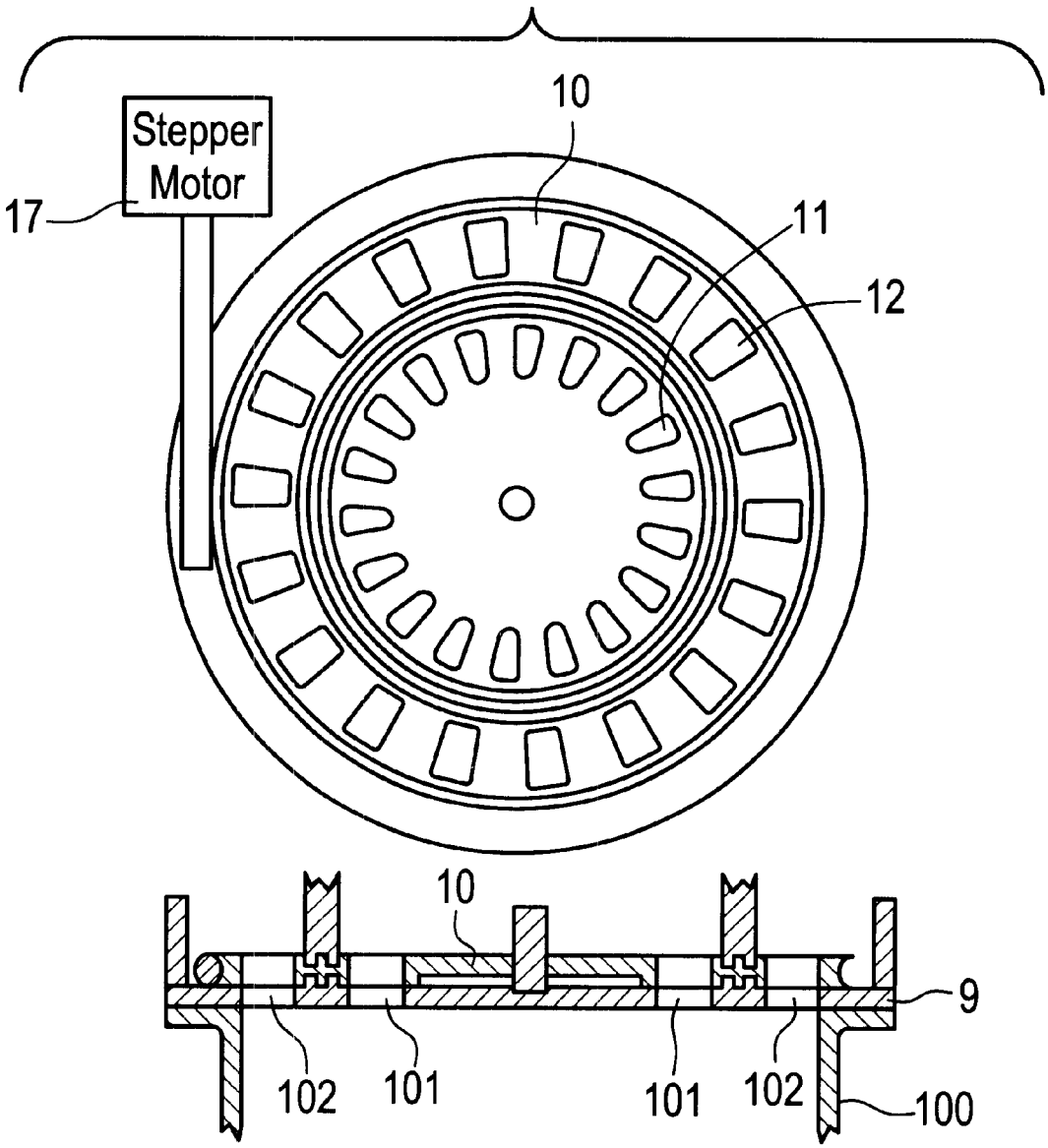
FIG. 4 illustrates a second embodiment utilizing stepper motors.

FIG. 4 is an embodiment without timing plate 15. The rotating disc valve 10 is shown with the two annuluses of slots, the inner annulus 11 (high pressure) and the outer annulus 12 (low pressure). The disc is driven by a stepper motor and worm gear 17.

Figure 5:
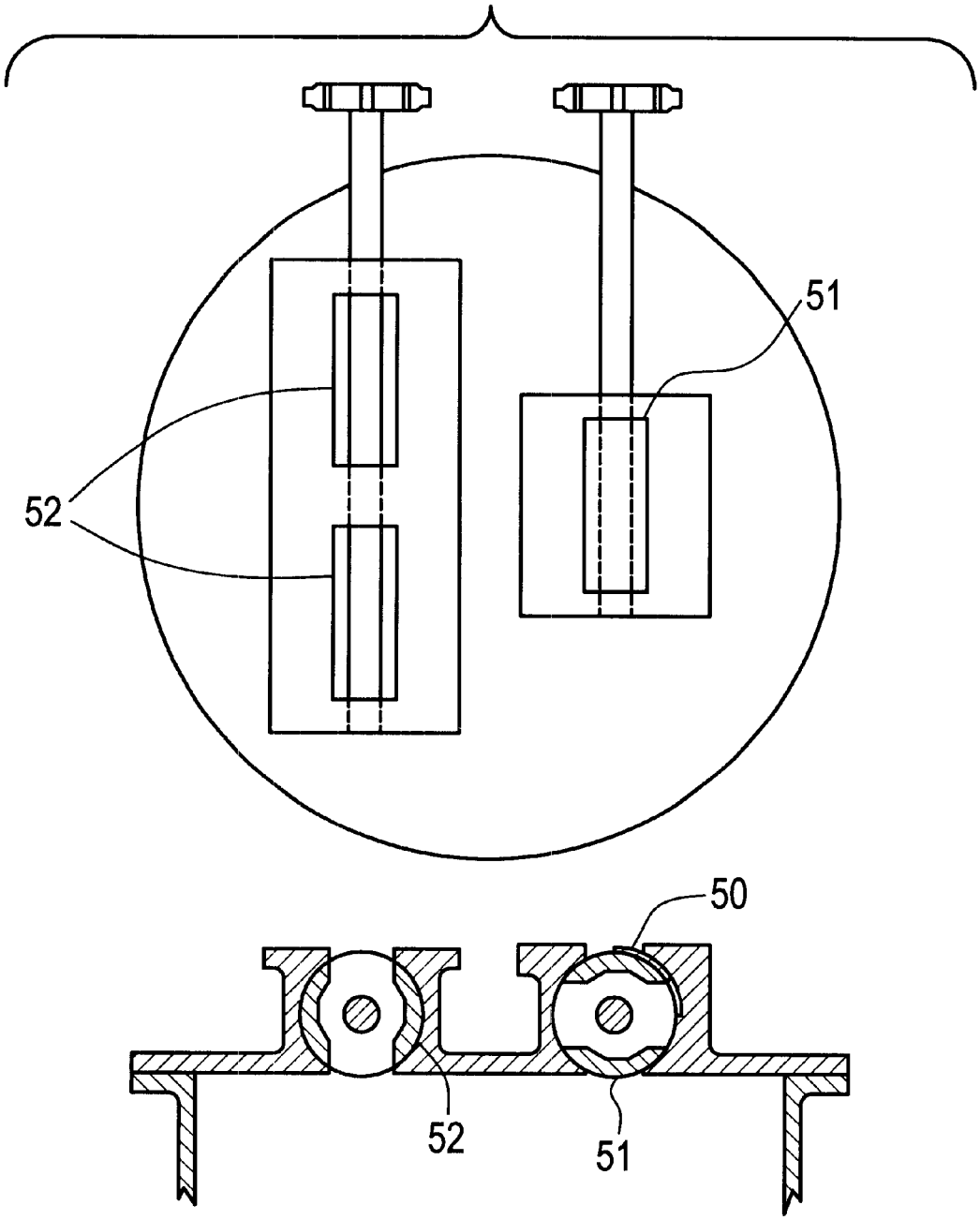
FIG. 5 shows a third embodiment using a movable timing edge.

There are various alternative designs for the timing valve. FIG. 5 shows a rotary cylinder valve which is belt or gear driven from the compressor drive shaft. A movable timing edge 50 on the inlet valve 51 provides adjustable control over the opening or closing events. FIG. 5 shows the discharge port fully open by the position of discharge valve 52 and the inlet port closed by valve 51.

If desired, the timing edge 50 can be removed from the device of FIG. 5 and the valve 51 sized to fill the opening in the cylinder head so that the device is sealed. Variable valve timing is not possible in that arrangement with continuous rotational motion. However, variable valve timing can be accomplished with a stepper motor drive system. This approach requires that at least one valve be driven by a device such as a stepper motor.

Figure 6:
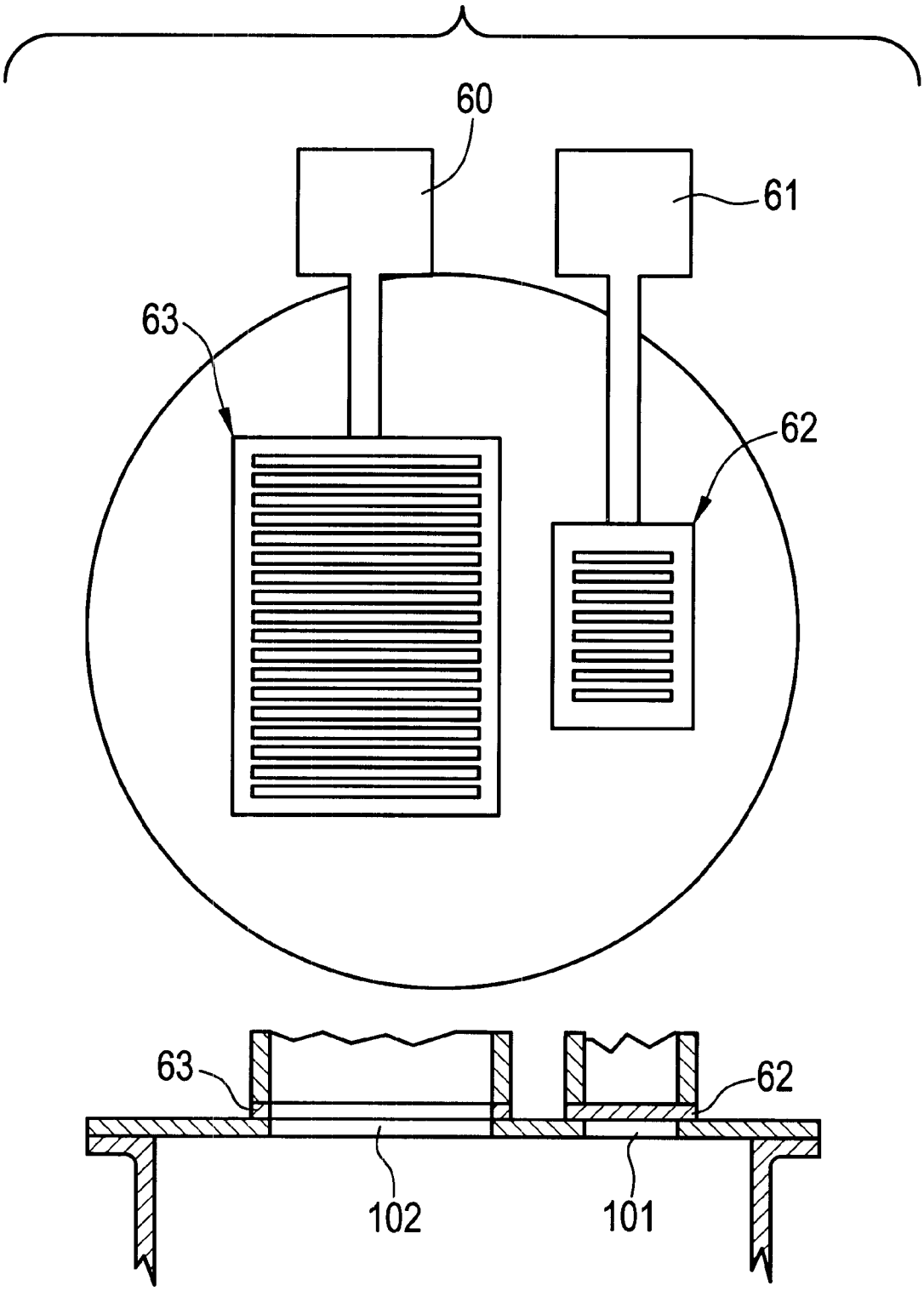
FIG. 6 shows another embodiment with no timing edge.

Another alternative is a variable timing shuttle plate valve as shown in FIG. 6. Reversible stepper motors, solenoids or other such devices are used to provide precise opening and closing events on the reciprocating inlet and outlet plates 62 and 63. The plates shuttle back and forth, sequentially covering and uncovering inlet and discharge ports 101 and 102.

A drive alternative, not shown, is to use a planetary ring gear to drive the valve plate. Such a device uses a similar pattern of slots as the rotating disc valve described above and is comprised of a stationary cylinder head with an arrangement of openings through which fluids are allowed to pass in either direction, a continuously moving valve plate with holes that create, through the motion, a gaging event for flow in both directions, and a stationary manifold connection. The continuously moving valve plate is rigidly attached to the ring gear of a planetary gear set. Timing adjustment is accomplished with a movable, timing edge adjustment plate as described above for the rotating disc valve.

Figure 7:
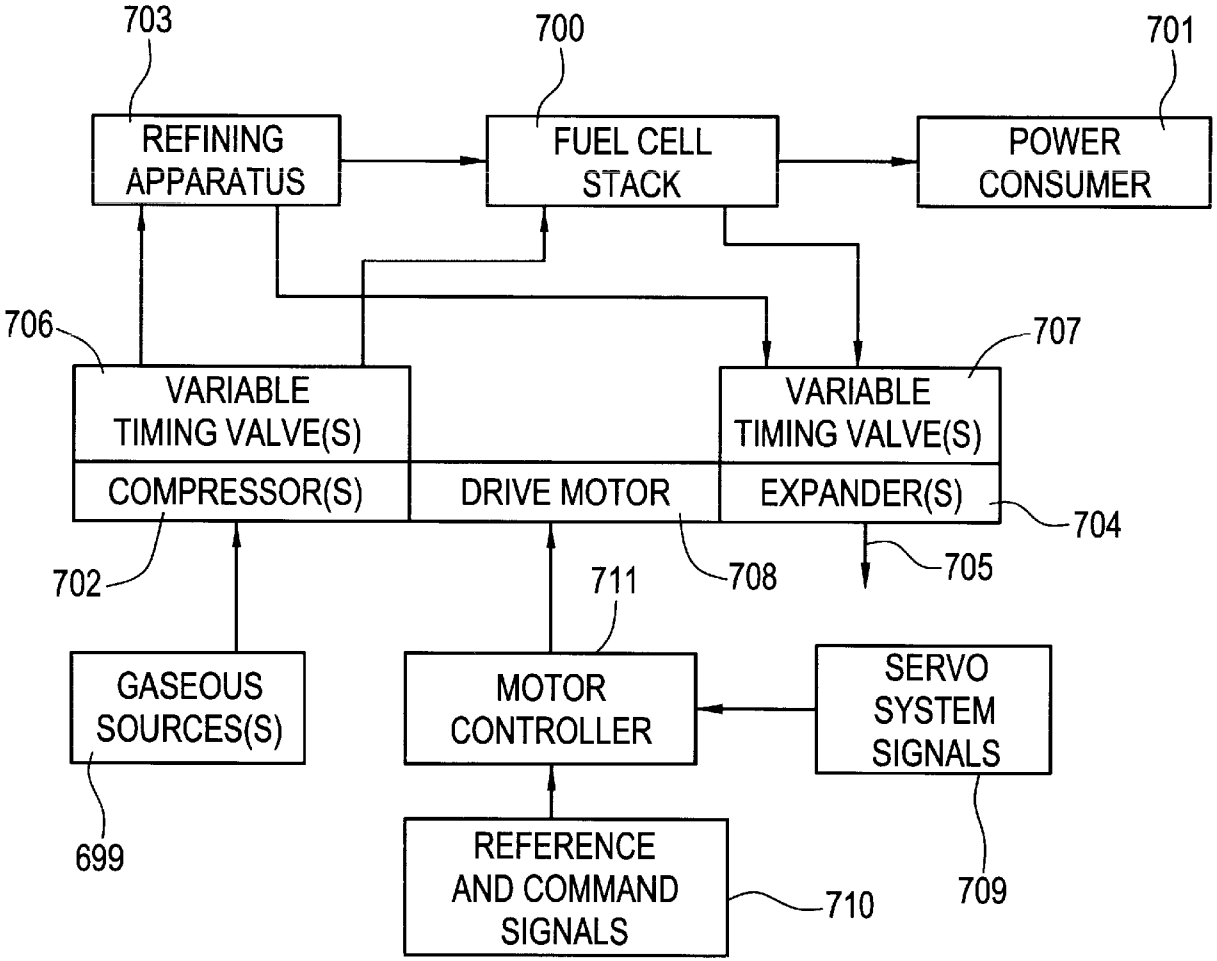
FIG. 7 is a block diagram of a fuel cell powering system using the variable timing valve of this invention.

FIG. 7 is a block diagram showing the application of the variable timing valve to compressors and expanders in a fuel cell powering system. A fuel cell stack 700 supplies power to a power consumer 701 which may be, for example, a vehicle. If the fuel cell stack is a PEM fuel cell, sources of oxygen and hydrogen are needed. In such a system, air is usually compressed as the gaseous source 699 of oxygen by compressor(s) 702 and supplied to the fuel cell stack 700. A refining apparatus 703 could be used to refine a source of hydrogen 699 such as natural gas so that hydrogen can be delivered to the fuel cell stack 700. In such case, compressor(s) 702 may be utilized to deliver a compressed gas such as natural gas to the refining apparatus 703. To recover unused energy from the refining apparatus 703 and/or the fuel cell stack 700, exhaust from each of those components can be fed back to expander(s) 704. Expander (s) 704 are preferably connected to the drive shaft of motor 708 which supplies motive force to compressor(s) 702 so that energy from the exhaust is returned to the compressor(s) drive shaft. Exhaust 705 may be to the atmosphere or to a collecting tank.

Where the power consumer has stringent requirements, such as a vehicle, independent control over pressure and mass flow of oxygen and hydrogen is needed to control the power output of the fuel cell stack. To accomplish that task, variable timing valves 706 and/or 707 are utilized and, additionally, afford the opportunity to match the expanding and compressing functions over the operating range. A servo system controller 711 receives feedback 709 from the power consumer 701, such as the vehicle, and receives commands from a command and reference source 710 such as the driver of the vehicle. Feedback may also be received from the fuel cell stack, the refining apparatus or any other system element as needed. Signals 709 and 710 are amalgamated by motor controller 711 to adjust the speed of drive motor 708.

While the invention has been shown and described with reference to preferred embodiments thereof, it should be understood that changes in the form and details of the invention may be made therein without departing from the spirit and scope of the invention.

What is claimed is:

1. A variable timing valve for a fluid supply apparatus comprising a movable element having inlet and outlet slots therein;

a cylinder head with ports comprised of inlet ports and discharge ports, the number of inlet ports equal to the number of discharge ports, inlet slots, and outlet slots, said movable element positioned adjacent to said cylinder head such that said inlet and outlet slots can be moved into a first position that blocks said ports, into a second position that opens said inlet ports, and into a third position that opens said discharge ports; and a movable timing edge positioned adjacent to said cylinder head, said movable timing edge capable of blocking a portion of at least one of said inlet and discharge ports.

2. The variable timing valve of claim 1 wherein said movable element is a rotating elements rotating in one direction.

3. The variable timing valve of claim 2 further including a non-rotating interconnect plate adjacent to said movable element to connect said cylinder head to inlet and discharge manifolds and to hold said movable element and said movable timing edge in intimate contact with said cylinder head.

4. The variable timing valve of claim 1 wherein said movable timing edge is independently adjustable with respect to the motion of said movable element.

5. The variable timing valve of claim 4 further including a plurality of timing edges, each edge associated with one of said ports and independently adjustable with respect to its associated port.

6. The variable timing valve of claim 4 further including a cylinder attached to said cylinder head and wherein said discharge ports are positioned relatively near the walls of said cylinder and said inlet ports are positioned relatively near the center of said cylinder.

7. The variable timing valve of claim 6 wherein said fluid supply apparatus comprises a compressor and an expander and wherein said variable timing valve is positioned on the inlet of said expander.

8. The variable timing valve of claim 7 wherein said compressor and said expander are part of a fuel cell powering system comprising a fuel cell stack and wherein said compressor is connected to supply fluid to said fuel cell stack and said expander is connected to receive exhaust from said fuel cell stack.

9. The variable timing valve of claim 8 wherein said fuel cell powering system includes the generation of servo signals for controlling the output of said powering system and the efficiency of said fluid supply apparatus including the adjustment of said timing edge.

10. The variable timing valve of claim 9 wherein said movable element is a rotating element, rotating in one direction.

11. A method of controlling the efficiency of fluid supply apparatus as the delivery requirement of volume and pressure change comprising providing said apparatus including a cylinder head with inlet ports and discharge ports;

providing a movable element with inlet slots and outlet slots which in assembly is positioned adjacent said cylinder head such that the inlet and outlet slots can be moved into a first position that opens said inlet ports and into a second position that opens said discharge ports;

providing a movable timing edge which in assembly is positioned adjacent to said cylinder head, said movable timing edge capable of blocking at least a portion of at least one of said inlet and discharge ports.

12. The method of claim 11 further including providing for the rotation of said movable timing element in one direction; and providing for the positioning of said movable timing element independent of the motion of said movable element.

13. The method of claim 12 further including providing for a non-rotating interconnect plate which in assembly is adjacent to said movable element and cylinder head to connect said inlet and discharge ports to inlet and discharge manifolds and to hold said movable element and said movable timing edge in intimate contact with said cylinder head.

14. The method of claim 11 further including providing for the adjustment of said timing edge independently of the motion of said movable element.

15. The method of claim 14 further including a plurality of timing edges, each edge associated with one of said ports and independently adjustable with respect to its associated port.

16. The method of claim 14 further including providing for a cylinder which in assembly is attached to said cylinder head, said discharge ports located relatively near the walls of said cylinder and said inlet ports located relatively near the center of said cylinder.

17. The method of claim 16 further including providing said fluid supply apparatus with a compressor and an expander, said movable element and said movable timing edge positioned in assembly with at least said expander.

18. The method of claim 17 further including providing for a fuel cell powering system with a fuel cell stack, said compressor connected to supply fluid to said fuel cell stack and said expander connected to receive exhaust from said fuel cell stack; and providing for the control of the output of said fuel cell powering system including adjustment of said movable timing edge to block more or less of its associated port in accordance with servo signals from said fuel cell powering system.

* * * * *